US010174637B2

(12) United States Patent
Imfeld et al.

(10) Patent No.: US 10,174,637 B2
(45) Date of Patent: Jan. 8, 2019

(54) DEVICE AND METHOD FOR MOUNTING OR DISMANTLING, REPLACEMENT AND MAINTENANCE OF A CAN-COMBUSTOR

(71) Applicant: ANSALDO ENERGIA SWITZERLAND AG, Baden (CH)

(72) Inventors: Jost Imfeld, Scherz (CH); Hans-Christian Mathews, Zürich (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 370 days.

(21) Appl. No.: 14/835,991

(22) Filed: Aug. 26, 2015

(65) Prior Publication Data

US 2016/0108759 A1 Apr. 21, 2016

(30) Foreign Application Priority Data

Sep. 5, 2014 (EP) ..... 14183669

(51) Int. Cl.
*F01D 25/28* (2006.01)

(52) U.S. Cl.
CPC ..... *F01D 25/285* (2013.01); *F05D 2230/68* (2013.01); *F05D 2230/70* (2013.01); *F05D 2230/80* (2013.01); *Y10T 29/4932* (2015.01); *Y10T 29/49318* (2015.01); *Y10T 29/49346* (2015.01); *Y10T 29/49718* (2015.01); *Y10T 29/49721* (2015.01)

(58) Field of Classification Search
CPC ..... F01D 25/285; F05D 2230/68; F05D 2230/70; F05D 2230/80; Y10T 29/49346; Y10T 29/43989; Y10T 29/43932; Y10T 29/49718; Y10T 29/49721
USPC ..... 29/402.01, 402.03, 889.1, 889.2, 890.01
See application file for complete search history.

(56) References Cited

U.S. PATENT DOCUMENTS 3,432,911 A * 3/1969 Rodgers ..... B64F 5/50 29/281.1
4,932,861 A * 6/1990 Keller ..... F23C 7/002 431/173
5,911,680 A * 6/1999 Takeoka ..... F01D 25/285 431/154
5,921,075 A * 7/1999 Shimoyama ..... F01D 25/285 431/154
6,141,862 A * 11/2000 Matsui ..... F01D 25/285 29/278

(Continued)

FOREIGN PATENT DOCUMENTS

EP 0 321 809 A1 6/1989
EP 0 704 657 A2 4/1996
GB 2 306 155 A 4/1997

*Primary Examiner* — Bayan Salone
(74) *Attorney, Agent, or Firm* — Buchanan Ingersoll & Rooney PC

(57) ABSTRACT

The present invention concerning of a device for mounting or dismantling, replacement and maintenance of a can-combustor of a gas turbine engine including an assembly tool or assembly tool with additional frame having at least one lifting beam, at least one linear driver, wheels, at least one eccentric rolling hook for fixation of the gas turbine housing, optionally spacers for building the interface to the can-combustor, adapters, lifting points for the main crane. The eccentric rolling hook is connected to the gas turbine housing by giving in axial or quasi-axial direction a force for mounting or dismantling the can-combustor from the gas turbine housing.

13 Claims, 5 Drawing Sheets

(56) References Cited

U.S. PATENT DOCUMENTS

| | | | | |
|---|---|---|---|---|
| 7,941,905 | B2 * | 5/2011 | Garland | B64F 5/0081 244/54 |
| 8,567,202 | B2 * | 10/2013 | Heyerman | F02C 7/20 60/226.1 |
| 8,607,451 | B2 * | 12/2013 | Arase | F01D 9/023 269/47 |
| 8,677,589 | B2 * | 3/2014 | Ziekow | B23P 19/022 29/281.1 |
| 9,140,142 | B2 * | 9/2015 | Shiotani | F01D 9/023 |
| 9,255,522 | B2 * | 2/2016 | Sancewich | F01D 9/026 |
| 9,404,390 | B2 * | 8/2016 | Griese | F01D 25/285 |
| 2010/0287950 | A1 * | 11/2010 | Heyerman | F02C 7/20 60/797 |

* cited by examiner

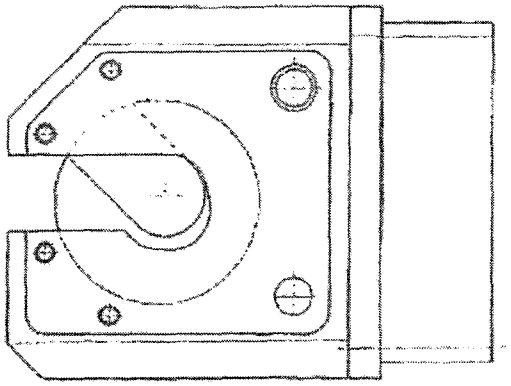
0° - Free
Fig. 5A
45° - locked, same radial position
Fig. 5B
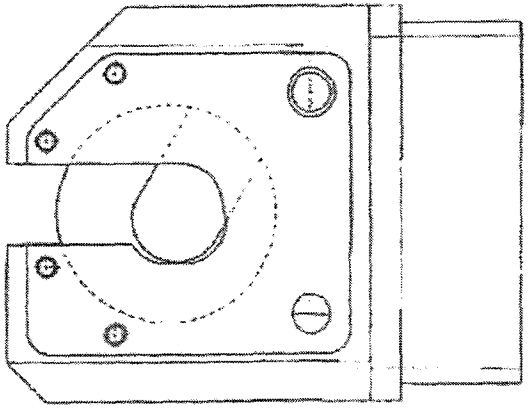
120° - locked
Fig. 5C
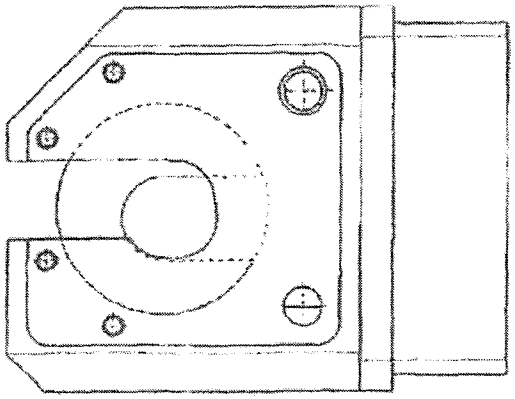
180° - locked, shifted in radial direction
Fig. 5D

DEVICE AND METHOD FOR MOUNTING OR DISMANTLING, REPLACEMENT AND MAINTENANCE OF A CAN-COMBUSTOR

CROSS-REFERENCE TO RELATED APPLICATIONS

This application claims priority to EP Application No. 14183669.2 filed Sep. 5, 2014, the contents of which are hereby incorporated in its entirety.

TECHNICAL FIELD

The present invention relates to device and method for mounting or dismantling, replacement and maintenance of a can-combustor, preferably a can-combustor of a gas turbine engine.

The gas turbine having a pattern of several can-combustors disposed around rotational contour.

Can-combustors are self-contained cylindrical combustion chambers. Each "can" has its own fuel injector, igniter, liner, and casing. The primary air from the compressor is guided into each individual can, where it is decelerated, mixed with fuel, and then ignited. The secondary air also comes from the compressor, where it is fed outside of the liner (inside of which is where the combustion is taking place). The secondary air is then fed, usually through slits in the liner, into the combustion zone to cool the liner via thin film cooling.

In most applications, multiple can-combustors are arranged around the central axis of the engine, and their shared exhaust is fed to the turbine(s). Can-combustors were most widely used in early gas turbine engines, owing to their ease of design and testing (one can test a single can, rather than have to test the whole system). Can-combustors are easy to maintain, as only a single can needs to be removed, rather than the whole combustion section.

Accordingly, the present invention refers fundamentally to a gas turbine engine comprising a compressor, downstream of the compressor several can-combustors, whereas the hot gases of the can-combustors are admitted to a turbine, whereas the can-combustors operating on the basis of can-combustor architecture.

Additionally, another gas turbine engine comprising a compressor, downstream of the compressor first can-combustor arrangement, whereas the hot gases of the first can-combustor arrangement are admitted to a first turbine or to a second can-combustor arrangement, whereas the hot gases of the second can-combustor arrangement are admitted to a second turbine or to a subsequent steam cycle, whereas at least one can-combustor arrangement operating on the basis of a can-combustor architecture.

Furthermore, at least one can-combustor comprising one or more disposed premixing burners or semi-premixing burners. A first turbine is connected to receive working gas from the first can-combustor arrangement, a second can-combustor arrangement is connected to receive exhausted working gas from the first turbine and to deliver working gas to the second turbine, wherein the second can-combustor arrangement comprises an annular duct forming a combustion space extending in a flow direction from outlet of the first turbine to an inlet of the second turbine, and means for introducing fuel into the second can-combustor arrangement for self-ignition combustion.

Additionally, the present invention also refers to a further type of combustor, namely a cannular-combustor; the term is a portmanteau of "can annular". Like the can-combustor, can annular combustors have discrete combustion zones contained in separate liners with their own fuel-injectors. Unlike the can-combustor, all the combustion zones share a common ring (annulus) casing. Each combustion zone no longer has to serve as a pressure vessel. The combustion zones can also "communicate" with each other via liner holes or connecting tubes that allow some air to flow circumferentially. The exit flow from the cannular-combustor generally has a more uniform temperature profile, which is better for the turbine section. It also eliminates the need for each chamber to have its own igniter. Once the fire is lit in one or two can-combustors, it can easily spread to and ignite the others.

BACKGROUND OF THE INVENTION

In a combustor mounting/demounting apparatus with the conventional technique according to state of the art, when replacing the combustor for use in the gas turbine engine, the piping and alike that are disposed around the combustor are demounted, and then a scaffold is assembled. A workman gets on the scaffold and operates an overhead crane to thereby sling and replace the combustor. For this reason it is necessary to remove or restore a number of piping that have been assembled around the combustor over a wide range, and it is also necessary to perform the work of assembling and disassembling the scaffold.

As a result, in the above-mentioned conventional operation, a large number of man-hours are needed, and a long work term is spent, for replacing the combustor and the work incidental thereto. Also, in the above-mentioned conventional operation, the work of the scaffold is performed at an overhead position, and workmen do not always have the appropriate posture, which is dangerous. Further, in the above-mentioned conventional operation, the work such as crane operation and slinging work requires a high level of skill, but is low in working efficiency. The result is that during the performance of the work, the combustor or the main body of the gas turbine is sometimes impaired or damaged.

With reference to U.S. Pat. No. 5,911,680, in a gas turbine that is equipped, on a casing thereof, with a plurality of combustors in the circumferential direction thereof, there is provided a rail which is supported on a rail receiving stand that is movable on the ground and which is disposed in the form of a circular annulus or circular arc in correspondence with the disposition of the combustors. A slide mechanism is mounted on the rail so as to movable along the rail and is mounted so that the slide mechanism can enter into and retreat from the interior of the casing. A grip mechanism is mounted on an end portion of the slide mechanism and grips constituent parts of the combustor, such as a tail pipe, a nozzle and an inner cylinder. Also, in another aspect of the present embodiment, there are provided a rail that is shaped like a circular arc and is revolvably supported on the revolvable carriage, and a grip mechanism that grips constituent parts of the combustor.

SUMMARY OF THE INVENTION

The basic idea of the present invention concerning of a device for axial shifting of the can-combustor in a safe and accurate manner. The device is designed as an assembly tool to support the can-combustor and accurately slide it in and out from the gas turbine housing while using a main crane and a fixation to the gas turbine housing. This fixation will be realized with an innovative eccentric driven hook which enables to adjust the can-combustor in radial direction.

The invention includes not only the aspects of an assembly or disassembly operation of a can-combustor, but also the possibilities of replacement and maintenance of such a can-combustor.

Technical problem that the present invention had to solve pertains to circumferential pattern of can-combustors (hot gas components) in combination with required accurate mounting position is challenge for maintenance process.

In addition, considerable weight of each can-combustor (hot gas component) affects to design accurate and safe apparatus for mounting and dismantling of can-combustor. This maintenance process is a part of gas turbine engine outage time which is well defined time period and therefore shall be as shortest possible in order to reduce operating costs.

Purposefully, the device shall be designed as safe and accurate can-combustor replacement tool, and device should have the ability to support complete can-combustor weight during every step.

Adjustment of can-combustor in radial position and in angle in relation to axis of mounting position shall be possible during complete shifting path in order to align it with approaching position.

Accordingly, the device shall take into account confined space between neighbor can-combustor as well as demand minimized supporting the features a gas turbine housing and in addition not colliding with nearby auxiliary systems. The device shall have modular design, additional features for upper and lower half can-combustors, which fits with all the burner locations and allows simultaneous maintenance operations.

The process of the assembly procedure is as follows:

During the assembly procedure an assembly tool is always connected to the crane for upper situated can-combustors. The assembly tool can be separated in two structures: The inner structure which is directly connected to the can-combustor by using existing lifting points with respect to the can-combustor, and the outer structure which contains the assembly tool and the two rails. Inner and outer structures are connected and enable to axial shift extracting the can-combustor by use of linear drivers.

During the assembly of the lower situated half can-combustors the operation can be made with the same assembly tool, but if the crane is not useable for the lower half can-combustor an additional device in the form of a frame can be used, also combined with a fork lifter or other lifting device enables to extract the can-combustors. The angle of the assembly tool can be changed with the frame. In case that a fork lifter cannot guarantee the necessary movement it is possible to use supplementary auxiliary means with various characteristics.

The adjustment of the operational angle will be managed by the crane (or by the frame) while an eccentric rolling hook is connected to the gas turbine housing. In order to determine the correct angle of the can-combustor an angle gage will be used which is not shown on the mentioned Figure.

The mentioned adapters are available to enable access for all can-combustors. A special feature of this concept is the eccentric rolling hook which is driven by a worm gear. The eccentric rolling hook secures the assembly tool during extraction of the can-combustor while it is connected to the gas turbine housing and it enables to give a force in axial direction of the can-combustor.

Additionally, it makes thus possible to adjust the position of the can-combustor in radial direction. A clearance in between the stud and the eccentric rolling hook should be considered so that the crane operator can see whether the assembly tool is free from the gas turbine housing or not. The eccentric rolling hook of the assembly tool resp. lifting beam shall be connected to the gas turbine housing. Therefore, a particular counterpart with respect to the eccentric rolling hook will be required.

The mentioned counterpart will be bolted to the extra foreseen machined surface on the gas turbine housing and is made up of two side walls connected with a horizontal bar. A system of linear drivers together with several wheels has been chosen as preferred solution to push/pull the can-combustor inside the assembly tool.

Furthermore, the eccentric rolling hook is made up of one ring and an outer structure/casing. Inner ring and outer structure/casing are both slotted, so depending on the angle of the inner ring the eccentric rolling hook gets closed and secured by an electrical worm gear-connection. Additionally, the radial position can be adjusted due to the fact that the outer structure/casing has an additional cut out resp. eccentric disposition. The angle of the inner ring can be adjusted by an electric driven worm gear which has high precision and is self-locking.

The process of the disassembly procedure is as follows:

As a first step the majority of portal/nuts will be removed. Then the spacers will be assembled on the can-combustor, upstream lifting points. Afterwards the assembly tool will be lifted to the can-combustor by use of the crane so that the eccentric rolling hook is placed correctly to the gas turbine housing. After securing of the eccentric rolling hook, for example with electrically leaded means, the correct angle between gas turbine housing and assembly tool will be adjusted by use the crane, with the procedure that downstream situated ropes get loose as consequence.

A similar sequence takes place referring to all above identified operations in connection with lower arranged can-combustors. In this case the assembly tool working in connection with a frame.

If the assembly tool is in the right angle the height in radial direction can be adjusted with eccentric rolling hook. After the assembly tool will be mounted to the can-combustor by use of several bolts. From now on the can-combustor is connected to the assembly tool and ready for extraction.

Therefore, the remaining bolts on the can-combustor connecting flange, that are still supporting the can-combustor, will be removed. If necessary it can adjust the height with eccentric rolling hook to compensate the elasticity of the assembly tool. Then, it will be started to shift the can-combustor outside the gas turbine housing and ready for lifting. The next step is to tighten the downstream ropes, and subsequently adjusting the correct position by using the crane. The eccentric rolling hook shall be in clearance position and the assembly tool with can-combustor shall be loose. The final step consists to disconnect the eccentric rolling hook from the gas turbine housing so that the assembly tool together with the can-combustor can be lifted and brought to the lay down area.

The main advantages of the invention over the best existing solution are quantified as follows:

The radial adjustability due the eccentric rolling hook and the axially sliding feature of the lifting tool which a highly precise and fast disassembly/assembly procedure while using the connection to the gas turbine housing and the main crane resp. the frame, and subsequently it results a consistent reduction of maintenance time and cost. This invention can be used during planned or unplanned inspections, referring to servicing one or several can-combustors, and the mentioned dis-/assembly tools are used in all can-combustors, regardless of their initial position.

If the can-combustor is provided with a premix burners for the combustion of the gas turbine engine, these should preferably be formed by the combustion process and objects according to the documents EP 0 321 809 A1 and/or EP 0 704 657 A2, wherein these documents forming integral parts of the present description.

In particular, said premix burners can be operated with liquid and/or gaseous fuels of all kinds. Thus, it is readily possible to provide different fuels within the individual cans. This means also that a premix burner can also be operated simultaneously with different fuels.

Furthermore, the can-combustor is operated with a premix burner, for example according to EP 0 321 809 A1. This embodiment relating to a burner consisting of hollow part-cone bodies making up a complete body, having tangential air inlet slots and feed channels for gaseous and liquid fuels, wherein in that the centre axes of the hollow part-cone bodies have a cone angle increasing in the direction of flow and run in the longitudinal direction at a mutual offset. A fuel nozzle, which fuel injection is located in the middle of the connecting line of the mutually offset centre axes of the part-cone bodies, is placed at the burner head in the conical interior formed by the part-cone bodies.

Furthermore, EP 0 704 657 A2, relating to a burner arrangement for a heat generator, substantially consisting of a swirl generator, substantially according to EP 0 321 809 A1, for a combustion air flow and means for injection of fuel, as well of a mixing path provided downstream of said swirl generator, wherein said mixing path comprises transaction ducts extending within a first part of the path in the flow direction for transferring a flow formed in said swirl generator into the cross-section of flow of said mixing path, that joins downstream of said transition ducts.

BRIEF DESCRIPTION OF THE DRAWINGS

The invention shall subsequently be explained in more detail based on exemplary embodiments in conjunction with the drawing. In the drawing:

FIG. 5A is a view showing an angle alternative referring to the locked situation between the inner ring and outer structure/casing in connection with the additional cut out;

FIG. 5B is a view showing an angle alternative referring to the locked situation between the inner ring and outer structure/casing in connection with the additional cut out;

FIG. 5C is a view showing an angle alternative referring to the locked situation between the inner ring and outer structure/casing in connection with the additional cut out;

FIG. 5D is a view showing an angle alternative referring to the locked situation between the inner ring and outer structure/casing in connection with the additional cut out;

DETAILED DESCRIPTION

The starting point of this exemplary embodiment is a gas turbine engine in closed condition which has a pattern of several can-combustors disposed around of rotation contour in relation of the rotor of the gas turbine engine. The main target is to disassemble can-combustor, one in side, out from working location and after service move it back to desired place.

Figure 1:
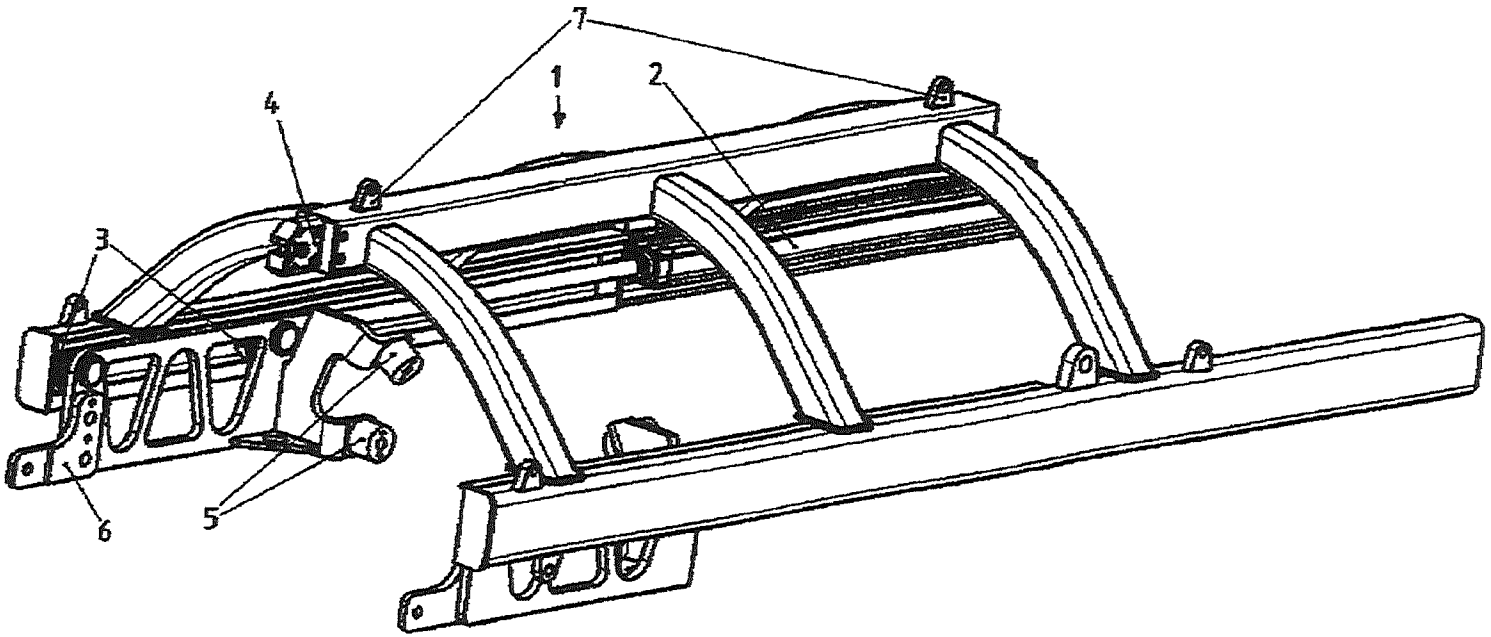
FIG. 1 is a holistically view showing a device (assembly tool) for mounting/dismantling a can-combustor for use in a gas turbine engine.

As illustrated in FIG. 1 a device for mounting and dismantling of a can-combustor comprising basically an assembly tool 1 with two rails which is characterized by several features and enables to dis-/assemble the can-combustor (see FIG. 2, item 15) for all position. The features are designed to adjust the position of the can-combustor during assembly procedure and to guarantee a precise extraction of the can-combustor while using an eccentric rolling hook 4 to the gas turbine housing (see FIG. 2, item 12) and the crane (not shown).

Therefore, the device for mounting and dismantling of a can-combustor consists of an assembly tool 1, linear drivers 2, wheels 3, an electrical driven eccentric rolling hook 4 for fixation of the gas turbine housing, optional spacers 5 which build the interface to the can-combustor by use of existing lifting points on the can-combustor, two different (also optional) adapters 6 to enable access for all can-combustors and lifting points 7 for the main crane are available.

During the assembly procedure of the upper situated can-combustors (wherever feasible also for the lower situated can-combustors) the assembly tool 1 is always connected to the crane (not shown). The assembly tool 1 can be separated in two structures. The inner structure which is directly connected to the can-combustor by using existing lifting points 7 with respect to the can-combustor, and the outer structure which contains the assembly tool 1 and the two rails. Inner and outer structures are connected and enable to axial shift extracting the can-combustor by use of linear drivers 2.

The adjustment of the angle will be managed by the crane while the eccentric rolling hook 4 is connected to the gas turbine housing. In order to determine the correct angle of the can-combustor an angle gage will be used which is not shown on the mentioned Figure.

The mentioned adapters 6 are available to enable access for all can-combustors. A special feature of this concept is the eccentric rolling hook 4 which is driven by a worm gear. The eccentric rolling hook 4 secures the assembly tool during extraction of the can-combustor while it is connected to the gas turbine housing and it enables to give a force in axial direction of the can-combustor.

Additionally, it makes thus possible to adjust the position of the can-combustor in radial direction. A clearance in between the stud and the eccentric rolling hook 4 should be considered so that the crane operator can see whether the assembly tool 1 is free from the gas turbine housing or not.

Figures 2, 3:
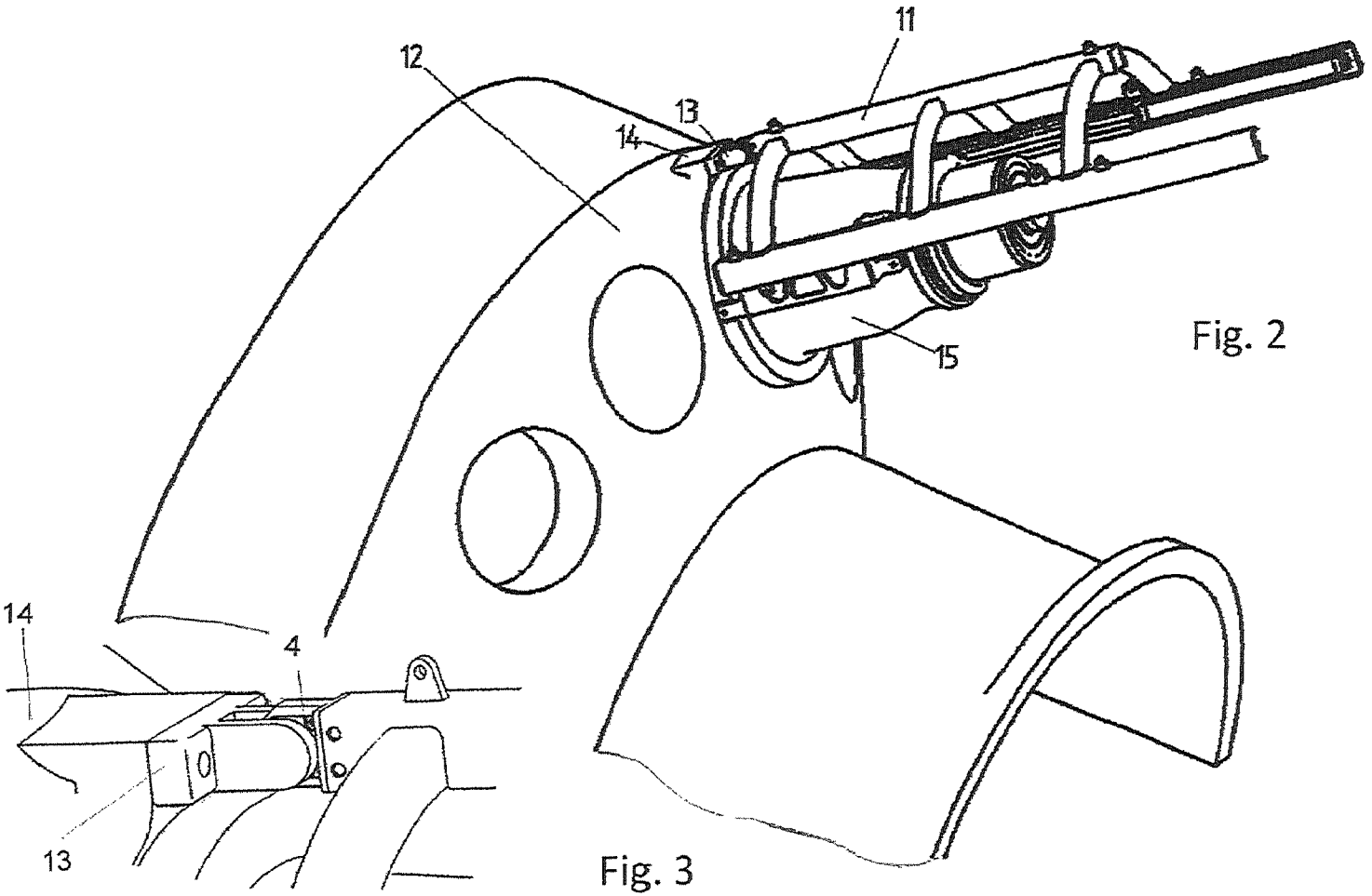
FIG. 2 is a holistically view showing a device for mounting/dismantling a can-combustor for use in a gas turbine engine during an operational stage in connection with the gas turbine housing.
FIG. 3 is a partially view showing a self-locking fixation between an eccentric rolling hook and a counterpart bolted to the machined surfaces of the gas turbine housing.

As illustrated in FIG. 2 the eccentric rolling hook 4 (see FIG. 1) of the assembly tool 1 resp. lifting beam 11 will be connected to the gas turbine housing 12. Therefore, a particular counterpart 13 with respect to the eccentric rolling hook 4 will be required.

The counterpart 13 will be bolted to the extra foreseen machined surface 14 on the gas turbine housing 12 and is made up of two side walls connected with a horizontal bar. A system of linear drivers together with several wheels has been chosen as preferred solution to push/pull the can-combustor 15 inside the assembly tool 1.

FIG. 3 shows a particular counterpart 13 which operates in connection with the eccentric rolling hook 4 to achieve a solid detachable connection between the assembly tool 1 and the gas turbine housing 12, serving both for the assembly and dismantling of the can-combustor 15.

Figure 4:
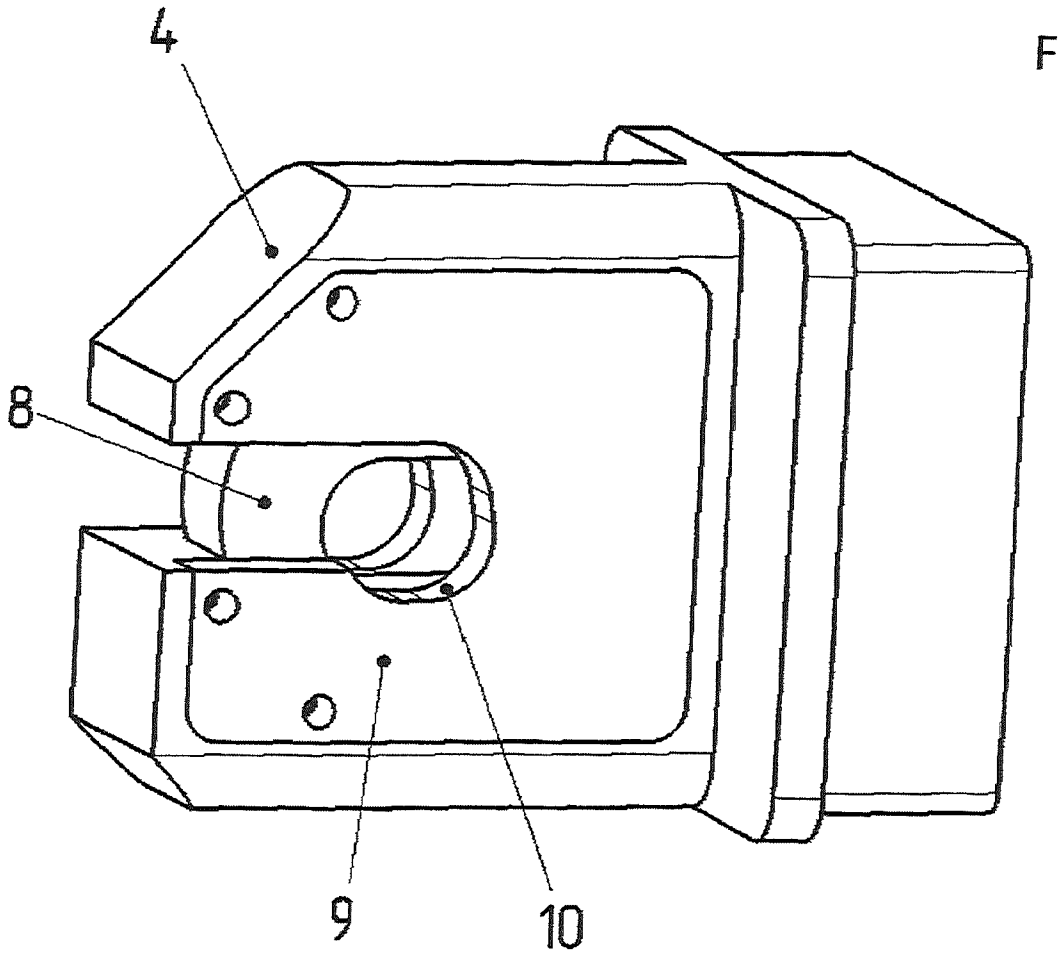
FIG. 4 is a partially view showing the inner ring and outer structure/casing of the eccentric rolling hook comprising an additional cut out.

As illustrated in FIG. 4 the eccentric rolling hook 4 is made up of one ring and an outer structure/casing. Inner ring 8 and outer structure/casing 9 are both slotted, so depending on the angle of the inner ring 8 the eccentric rolling hook 4 gets closed and secured by an electrical worm gear-connection. Additionally, the radial position can be adjusted due to the fact that the outer structure/casing 9 has an additional cut out 10. The angle of the inner ring 8 can be adjusted by an electric driven worm gear which has high precision and is self-locking.

FIG. 5A to 5D show various angle alternatives referring to the locked situation between the inner ring 8 and outer structure/casing 9 in connection with the additional cut out 10 (see also FIG. 4).

One of the essential advantage of the embodiment concerns also to be seen that the other way around is also feasible in the sense that the outer structure of the eccentric rolling hook 4 comprising movable/turnable outer structure/casing 9 while the inner ring 8 behaves stationary or contrariwise, namely, that the inner ring 8 is movable/turnable while the outer structure/casing 9 behaves stationary, whereby the introduction of the second mentioned embodiment corresponds to an action of a person skilled in the art.

Figure 6:
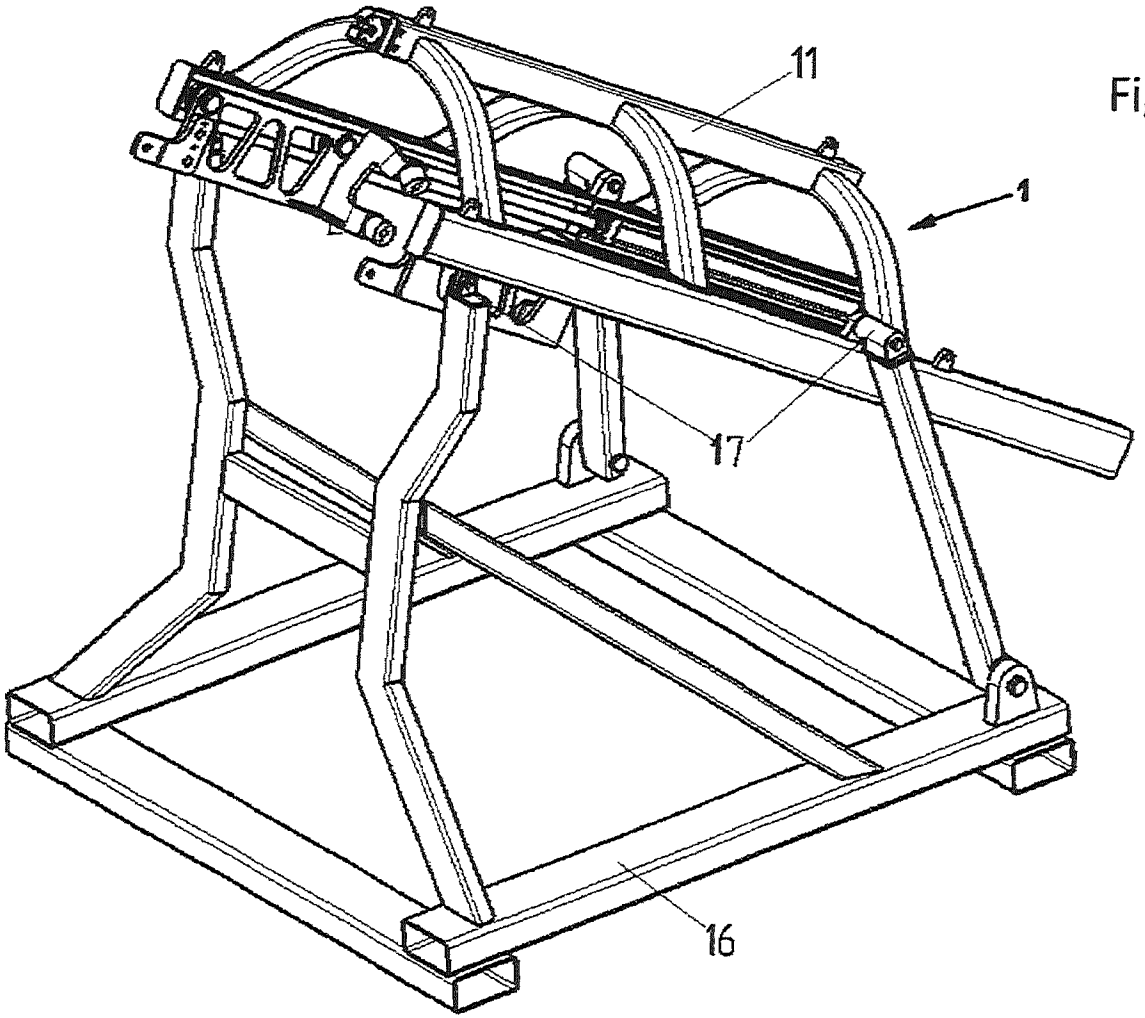
FIG. 6 is a holistically view showing a further device (assembly tool with an additional frame) combined with a fork lifter or other lifting device.

As illustrated in FIG. 6 dis-/assembly of the lower situated half can-combustors are also possible with the same assembly tool, however, an additional device in form of a frame 16 is required. Due to the fact that crane is not always useable for the lower situated half can-combustor the frame 16 combined with a fork lifter or other lifting device enables to extract the can-combustors. The angle of the assembly tool can be changed with the frame 16. In case that a fork lifter cannot guarantee the necessary movement it is possible to use supplementary pivot mounting (not shown).

Referring to the disassembly procedure the following steps are consistent: As a first step the majority of portal/nuts will be removed. Then the spacers will be assembled on the can-combustor 15, upstream lifting points 7. Afterwards the assembly tool 1 will be lifted to the can-combustor 15 by use of the crane so that the eccentric rolling hook 4 is placed correctly to the gas turbine housing 12. After securing of the eccentric rolling hook 4, for example with electrically leaded means, the correct angle between gas turbine housing 12 and assembly tool 1 will be adjusted by use the crane, with the procedure that downstream situated ropes get loose as consequence.

If the assembly tool 1 is in the right angle the height in radial direction can be adjusted with eccentric rolling hook 4. After the assembly tool 1 will be mounted to the can-combustor 15 by use of several bolts. From now on the can-combustor 15 is connected to the assembly tool 1 and ready for extraction.

Therefore, the remaining bolts on the can-combustor to the gas turbine housing 12 that are still supporting the can-combustor 15, will be removed. If necessary it can adjust the height with eccentric rolling hook 4 to compensate the elasticity of the assembly tool 1. Then it will be started to shift the can-combustor 15 outside the gas turbine housing 12 and ready for lifting. The next step is to tighten the downstream ropes, and subsequently adjusting the correct position by using the crane.

The eccentric rolling hook 4 shall be in clearance position and the assembly tool 1 with can-combustor 15 shall be loose. The final step consists to disconnect the eccentric rolling hook 4 from the gas turbine housing 12 so that the assembly tool together with the can-combustor 15 can be lifted and brought to the lay down area.

A similar sequence takes place referring to all above identified operations in connection with lower arranged can-combustors. In this case the assembly tool 1 working in connection with a frame 16 (see also FIG. 6).

The invention claimed is:

1. A device for mounting or dismantling, replacement and maintenance of a can-combustor of a gas turbine engine, the device comprising:

an assembly tool or assembly tool with an additional frame having at least one lifting beam;

at least one linear driver;

wheels;

at least one eccentric rolling hook configured for fixation of a gas turbine housing, and the at least one eccentric rolling hook includes an outer structure/casing which is movable/turnable and an inner ring which behaves stationary, or an inner ring which is movable/turnable and an outer structure/casing which behaves stationary; and lifting points for a crane, wherein the at least one eccentric rolling hook is configured to be connected to a gas turbine housing by applying in an axial or quasi-axial direction a force for mounting or dismantling the can-combustor relative to the gas turbine housing.

2. The device according to claim 1, wherein the at least one eccentric rolling hook comprising:

an adjustment device, discretely or operatively communicating with the crane, to adjust a position of a can-combustor in a radial or quasi-radial position.

3. The device according to claim 1, comprising:

electrical means or a worm gear for driving the eccentric rolling hook.

4. The device according to claim 1, wherein the at least one eccentric rolling hook is configured to be self-locking with respect to a counterpart attached to a gas turbine housing.

5. The device according to claim 4, in combination with a counterpart bolted to a machined surface of the gas turbine housing.

6. The device according to claim 1, wherein the assembly tool or the assembly tool with the additional frame is configured to avoid collision with nearby can-combustors and auxiliary systems.

7. A method for mounting of a can-combustor with a device for mounting or dismantling, replacement and maintenance of the can-combustor of a gas turbine engine, the device comprising:

an assembly tool or assembly tool with an additional frame having at least one lifting beam;

at least one linear driver;

wheels;

at least one eccentric rolling hook configured for fixation of a gas turbine housing, and the at least one eccentric rolling hook includes an outer structure/casing which is movable/turnable and an inner ring which behaves stationary, or an inner ring which is movable/turnable and an outer structure/casing which behaves stationary; and lifting points for a crane, wherein the at least one eccentric rolling hook is configured to be connected to a gas turbine housing by applying in an axial or quasi-axial direction a force for mounting or dismantling the can-combustor relative to the gas turbine housing, the method comprising:

during an assembly procedure the assembly tool is always connected to a crane;

an adjustment of an angle with respect to an assembling direction of the can-combustor is managed by the crane;

adjusting and fixing the can-combustor within the right a desired operational position into the gas turbine housing; and removing the assembly tool from an impact region of the can-combustors.

8. A method for dismantling or replacement of a can-combustor with a device for mounting or dismantling, replacement and maintenance of the can-combustor of a gas turbine engine, the device comprising:

an assembly tool or assembly tool with an additional frame having at least one lifting beam;

at least one linear driver;

wheels;

at least one eccentric rolling hook configured for fixation of a gas turbine housing, and the at least one eccentric rolling hook includes an outer structure/casing which is movable/turnable and an inner ring which behaves stationary, or an inner ring which is movable/turnable and an outer structure/casing which behaves stationary; and lifting points for a crane, wherein the eccentric rolling hook is configured to be connected to a gas turbine housing by applying in an axial or quasi-axial direction a force for mounting or dismantling the can-combustor relative to the gas turbine housing, the method comprising:

removing a majority of portal/nuts;

lifting the assembly tool to the can-combustor by the crane;

placing the eccentric rolling hook relative to the gas turbine housing;

after securing the eccentric rolling hook, adjusting, a desired angle between gas turbine housing and assembly tool by the crane;

after the assembly tool is in the desired angle, adjusting a height in radial direction with the eccentric rolling hook;

mounting the assembly tool to the can-combustor by several bolts;

connecting the can-combustor to the assembly tool for extraction;

removing any remaining bolts on the can-combustor that are still supporting the can-combustor;

adjusting a height with the eccentric rolling hook to compensate dimensional differences or elasticity of the assembly tool;

starting to shift the can-combustor outside the gas turbine housing until it reaches a maximum stroke of the assembly tool; and adjusting with the crane to maintain the desired angle such that the can-combustor, positioned outside the gas turbine housing, is ready for lifting.

9. A method for maintenance of a can-combustor with a device for mounting or dismantling, replacement and maintenance of the can-combustor of a gas turbine engine, the device comprising:

an assembly tool or assembly tool with an additional frame having at least one lifting beam;

at least one linear driver;

wheels;

at least one eccentric rolling hook configured for fixation of a gas turbine housing, and the at least one eccentric rolling hook includes an outer structure/casing which is movable/turnable and an inner ring which behaves stationary, or an inner ring which is movable/turnable and an outer structure/casing which behaves stationary; and lifting points for a crane, wherein the at least one eccentric rolling hook is configured to be connected to a gas turbine housing by applying in an axial or quasi-axial direction a force for mounting or dismantling the can-combustor relative to the gas turbine housing, the method comprising:

removing the majority of portal/nuts;

lifting the assembly tool to the can-combustor by the crane;

placing the eccentric rolling hook relative to the gas turbine housing;

after securing the eccentric rolling hook, adjusting a desired angle between gas turbine housing and assembly tool by the crane;

after the assembly tool is in the desired angle, adjusting height in radial direction with the eccentric rolling hook;

mounting the assembly tool to the can-combustor by several bolts;

connecting the can-combustor to the assembly tool for extraction;

removing any remaining bolts on the can-combustor that are still supporting the can-combustor;

adjusting a height with the eccentric rolling hook to compensate dimensional differences or elasticity of the assembly tool;

starting to shift the can-combustor outside the gas turbine housing until it reaches a maximum stroke of the assembly tool;

adjusting with the crane to maintain the angle such that the can-combustor is outside the gas turbine housing and ready for lifting; and after the maintenance operation is completed, remounting the can-combustor as follows:

during the assembly procedure the assembly tool is always connected to the crane:

managing adjustment of the angle with respect to the assembling direction of the can-combustor by the crane;

adjusting and fixing the can-combustor within a desired operational position into a gas turbine housing; and removing the assembly tool from an impact region of the can-combustor.

10. A method for mounting of a can-combustor with the use of the device as claimed in claim 1, the method comprising:

during an assembly procedure the assembly tool with the additional frame is connected to the crane or operates independently with other transport means;

the adjustment of the angle with respect to the assembling direction of the can-combustor is managed by the crane or operates independently with other transport means being actively connected to the eccentric rolling hook which is actively connected to a counterpart attached to the gas turbine housing;

adjusting and fixing the can-combustor within the desired operational position into the gas turbine housing; and removing the assembly tool with additional frame from an impact region of the can-combustor.

11. A method for dismantling or replacement of a can-combustor with the use of the device as claimed in one claim 1, the method comprising:

removing a majority of portal/nuts;

lifting the assembly tool with the additional frame to the can-combustor by the crane or operating the assembly tool with the additional frame independently with other transport means;

placing the eccentric rolling hook relative to the gas turbine housing;

after securing the eccentric rolling hook a desired angle between gas turbine housing and the assembly tool with the additional frame by the crane or other transport means;

after the assembly tool with the additional frame is in the desired angle adjusting a height in a radial direction with the eccentric rolling hook;

mounting the assembly tool with the additional frame to the can-combustor by several bolts;

connecting the can-combustor to the assembly tool with the additional frame for extraction;

removing any remaining bolts on the can-combustor that are still supporting the can-combustor;

adjusting a height with the eccentric rolling hook to compensate dimensional differences or elasticity of the assembly tool with the additional frame;

starting to shift the can-combustor outside the gas turbine housing until it reaches a maximum stroke of the assembly tool with the additional frame;

adjusting with the crane or other transport means to maintain the desired angle such that the can-combustor positioned outside the gas turbine housing, is ready for lifting.

12. A method for maintenance of a can-combustor with the use of the device as claimed in claim 1, the method comprising:

removing a majority of portal/nuts;

lifting the assembly tool with the additional frame to the can-combustor by the crane or operating the assembly tool with the additional frame independently with other transport means;

placing the eccentric rolling hook relative to the gas turbine housing;

after securing the eccentric rolling hook a desired angle between gas turbine housing and the assembly tool with the additional frame by the crane or other transport means;

after the assembly tool with the additional frame is in the desired angle adjusting a height in a radial direction with the eccentric rolling hook;

mounting the assembly tool with the additional frame to the can-combustor by several bolts;

connecting the can-combustor to the assembly tool with the additional frame for extraction;

removing any remaining bolts on the can-combustor that are still supporting the can-combustor;

adjusting a height with the eccentric rolling hook to compensate dimensional differences or elasticity of the assembly tool with the additional frame;

starting to shift the can-combustor outside the gas turbine housing until it reaches a maximum stroke of the assembly tool with the additional frame;

adjusting with the crane or other transport means to maintain the desired angle such that the can-combustor positioned outside the gas turbine housing, is ready for lifting;

after the maintenance operation is completed, the can-combustor is re-mounted according to the following steps:

during the assembly procedure the assembly tool with the additional frame is connected to the crane or operates independently with other transport means;

the adjustment of the angle with respect to the assembling direction of the can-combustor is managed by the crane or other transport means is actively connected to the eccentric rolling hook which is actively connected to a counterpart attached to the gas turbine housing;

adjusting and fixing the can-combustor within the desired operational position into the gas turbine housing; and removing the assembly tool with additional frame from an impact region of the can-combustor.

13. The device according to claim 1, comprising:

spacers for building an interface to a can-combustor.

* * * * *